United States Patent [19]

Hahn

[11] 4,382,457

[45] May 10, 1983

[54] TREE HARVESTER

[76] Inventor: Raymond M. Hahn, P.O. Box 244, Two Harbors, Minn. 55616

[21] Appl. No.: 231,056

[22] Filed: Feb. 3, 1981

[51] Int. Cl.[3] ..... B27L 1/00

[52] U.S. Cl. ..... 144/2 Z; 83/157; 83/104; 83/380; 83/390; 83/801; 414/748

[58] Field of Search ..... 144/3 D, 2 Z, 34 R, 144/309 AC; 414/748; 83/157, 104, 380, 390, 154, 465, 801

[56] References Cited

U.S. PATENT DOCUMENTS

| | | | |
|---|---|---|---|
| 2,876,816 | 3/1959 | Busch | 144/2 Z |
| 2,981,301 | 5/1961 | Busch | 144/2 Z |
| 3,029,848 | 4/1962 | Bombardier | 144/2 Z |
| 3,039,344 | 6/1962 | Hercik | 144/2 Z |
| 3,059,677 | 10/1962 | Busch | 144/2 Z |
| 3,074,447 | 1/1963 | Bombardier | 144/2 Z |
| 3,078,886 | 2/1963 | Childress | 144/208 |
| 3,140,736 | 7/1964 | Propst | 144/2 Z |
| 3,183,951 | 5/1965 | Busch | 144/2 Z |
| 3,329,184 | 7/1967 | Longert | 144/2 Z |
| 3,398,774 | 8/1968 | Hahn | 144/2 Z |
| 3,580,306 | 5/1971 | Tanguay | 144/2 Z |
| 3,754,492 | 8/1973 | Krauss | 83/380 |
| 3,771,395 | 11/1973 | Heimeri | 83/795 |
| 3,881,533 | 5/1975 | Savage et al. | 144/3 |
| 3,882,910 | 5/1975 | Peltola et al. | 144/309 AC |
| 3,948,299 | 4/1976 | LaForge et al. | 144/2 |
| 4,170,911 | 10/1979 | Ayers | 83/104 |
| 4,294,295 | 10/1981 | Olin | 83/390 |

FOREIGN PATENT DOCUMENTS

| | | | |
|---|---|---|---|
| 256820 | 9/1960 | Australia . | |
| 642108 | 6/1962 | Canada . | |
| 645245 | 7/1962 | Canada . | |
| 685606 | 9/1962 | Canada . | |
| 33810 | 7/1952 | Sweden . | |
| 91250 | 3/1958 | U.S.S.R. . | |
| 209152 | 5/1966 | U.S.S.R. . | |
| 237697 | 6/1969 | U.S.S.R. | 414/748 |

*Primary Examiner*—W. D. Bray

*Attorney, Agent, or Firm*—Schroeder, Siegfried, Vidas, Steffey & Arrett

[57] ABSTRACT

A tree harvester comprising a mobile frame having a carriage with limb-stripping knives thereon which encircle the tree alternatively in snug or loosely-engaging relation, tree clamping means above the bed of the frame and saw means movably mounted on the clamping means for movement therewith and, in addition, between retracted position and lowered tree-sawing position. Selective rotary log-ejecting means is mounted adjacent the saw to eject the severed tree sections to either side, as desired. The limb-stripping knives progress the stripped portion of the tree beyond the saw and clamping means when in snug position, and strip the limbs off the tree when in loosely-engaging relation as the carriage moves away from the clamping means and saw.

16 Claims, 7 Drawing Figures

10
11
12
13
14
15
16
17
18
19
20
21
22
23
24
25
26
27
61
62
63
64
2
3
6

TREE HARVESTER

DESCRIPTION

Background of the Prior Art

This invention is an improvement upon the tree harvester shown in my earlier U.S. Pat. No. 3,398,774, which discloses a tree harvester which works on similar principles, but utilizes different and less practical log clamping and severing means and log-ejecting means. My prior patent, which has similar log progressing and stripping means, is believed to be the closest prior art. The severing mechanism of my prior patent, however, is vulnerable to serious damage and consequent extensive down-time if the harvester is operated by a careless or inattentive operator, since the cutting knife could be damaged by moving the dolly and tree longitudinally of the bed while the knife remained in lowered or cutting position.

BRIEF SUMMARY OF THE INVENTION

I have provided a new and improved apparatus in a tree harvester for holding and severing log sections after they have been debranched or stripped, and for selectively discharging such log sections. The saw means is mounted on and behind the tree clamping means so as to move with it and thereby, when in its retracted position, is located in an out-of-way and protected position while a new log is projected beneath the clamping means. The saw means is also movably mounted on the clamping means and moves downwardly through the log after the clamping means is applied to the tree trunk. As a consequence, the saw, when in retracted position, is always within several inches of the clamping edge and substantial time is thereby saved, and it is also always protected, without need for swinging same through an extensive path as has heretofore been the case. Switch means is carried by the clamping means in position to be activated by the saw means as the latter moves into sawing position, the switch functioning to close a valve in the hydraulic power line to the tree carriage in order to prevent movement of the latter and consequent damage to the saw while the latter is sawing through the tree trunk. A selective ejector is also provided in position to eject the cut sections of the tree to either of opposite sides of the bed, thereby enabling the operator to discharge the pulpwood portions of the tree to one side and the portions suitable to be sawed into lumber to the opposite side.

BRIEF DESCRIPTION OF THE DRAWINGS

A detailed description of one preferred embodiment of the tree harvester is hereafter described with specific reference being made to the drawings in which:

FIG. 2 is a vertical sectional view on an enlarged scale taken along line 2—2 of FIG. 1 with the clamping means shown in non-clamping position and the saw being in retracted position;

FIG. 3 is a side elevational view on the same scale as FIG. 2 and taken along line 3—3 of FIG. 1, portions thereof being shown in section;

FIG. 7 is a schematic diagram of the hydraulic circuit utilized to operate the basic elements of the tree harvester.

DETAILED DESCRIPTION OF INVENTION

The preferred embodiment of my invention is shown in FIGS. 1-7, inclusive, in simplified form. It is somewhat similar in construction and operation to my tree harvester as disclosed in my earlier U.S. Pat. No. 3,398,774, issued to me on Aug. 27, 1968 and entitled "Tree Harvester," to which reference is hereby made and the contents of which is hereby incorporated herein. The basic structure of the forward portion of my tree harvester, as disclosed herein, is substantially the same in construction and operation as that shown in may said patent up to the upstanding frame which carries the tree clamping and sawing mechanism.

Figures 1, 6:
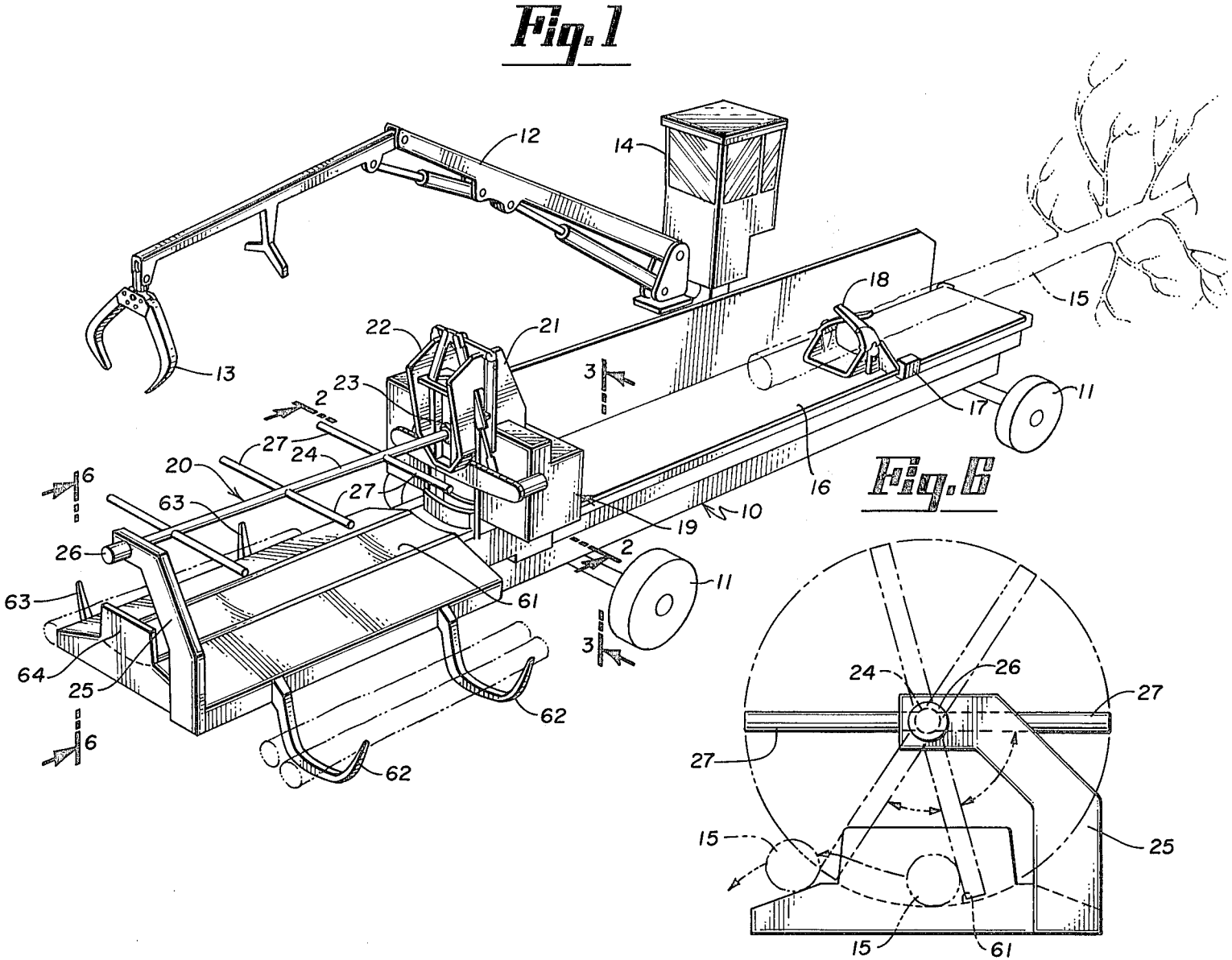
FIG. 1 is a perspective view of a tree harvester embodying my invention in simplified form.
FIG. 6 is a rear end elevational view of the selective log ejector mechanism taken long line 6—6 of FIG. 1 on an enlarged scale.

Thus, as shown in FIG. 1, my improved tree harvester includes a mobile frame 10 having wheels 11 (FIG. 7) and supporting a boom 12 with a grapple 13. The operator's cab 14 houses the operator who can operate the boom and grapple as well as the remainder of the machine, or if preferred, as is the case in actual practice, a second cab (not shown) may be provided to house a second operator who controls the entire machine with the exception of the boom. As is the case in my above patent, the grapple may be utilized to remove and pile the severed logs, as well as to pick up the felled but unharvested tree 15 to place it upon a bed 16 which is carried by the frame 10.

Carried by the frame 10 and mounted for reciprocating movement forwardly and rearwardly along the bed 16 is a powered carriage 17 which has a plurality of stripping blades 18 pivotally mounted thereon, similar in construction and operation to those carried by the dolly in my above patent. The carriage 17 may be powered, as in my above patent or in any other suitable manner which provides for reciprocating movement. At least some of these stripping blades 18 are powered by actuator means in the form of hydraulic cylinders **18*a* (FIG. 7) to swing between outwardly extending open position to encircling relation to the log of the tree to be harvested. As in my above patent, these stripping blades are powered and controlled by the operator so as to encircle and clamp the tree snugly as it moves rearwardly toward the log clamping and severing mechanism 19**, and to engage the same loosely as they move forwardly with the carriage along the trunk, to effectively sever the limbs from the trunk during such movement while the tree is held in clamped or fixed position by the clamping mechanism which is to be hereinafter described.

The novel portions of my improved tree harvester are to be found in the clamping and severing mechanism 19 and in the selective tree ejector mechanism 20. The mechanism 19 includes an upright U-shaped framework 21 mounted upon the frame 10 in fixed position at the end of travel of the carriage 17. The framework 21 has a yoke or gooseneck portion 22 which extends rearwardly and downwardly from the upper portions of the framework to furnish a mount for a carrier bearing 23 within which the forward end of the selective ejector 20 is rotatably mounted. As best shown in FIG. 1, the ejector 20 includes an elongated shaft 24 which extends rearwardly from the bearing 23 and has its opposite end rotatably mounted in a fixed upstanding mounting arm 25 which is part of the frame 10. A bi-directional hydraulic motor 26 rotates the shaft 24 about its longitudinal axes in whichever direction is selected by the operator, as desired. Hydraulic lines (not shown) extend to the motor 26 and the fluid moving therethrough is controlled by the operator through appropriate valves within the operator's cab. Pairs of radial kick-out arms 27 extend outwardly from the shaft 24 in opposite directions.

Figure 4:
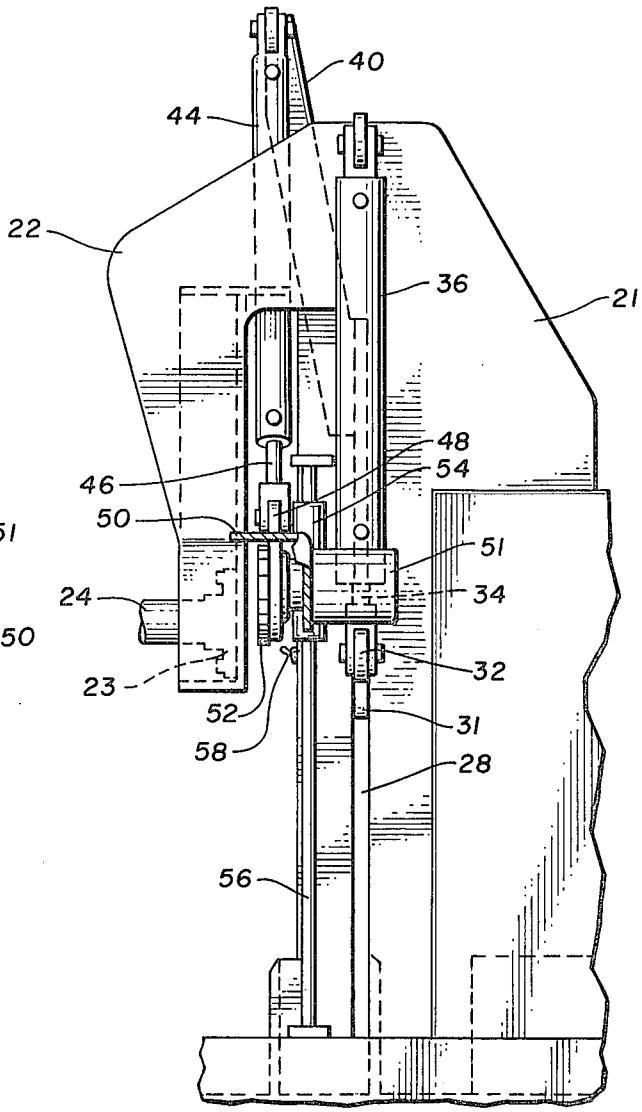
FIG. 4 is a vertical sectional view on the same scale as FIG. 2 and taken along approximately the same line, but with the tree clamp shown in clamping position and the saw shown in log severing position.
Figure 1:
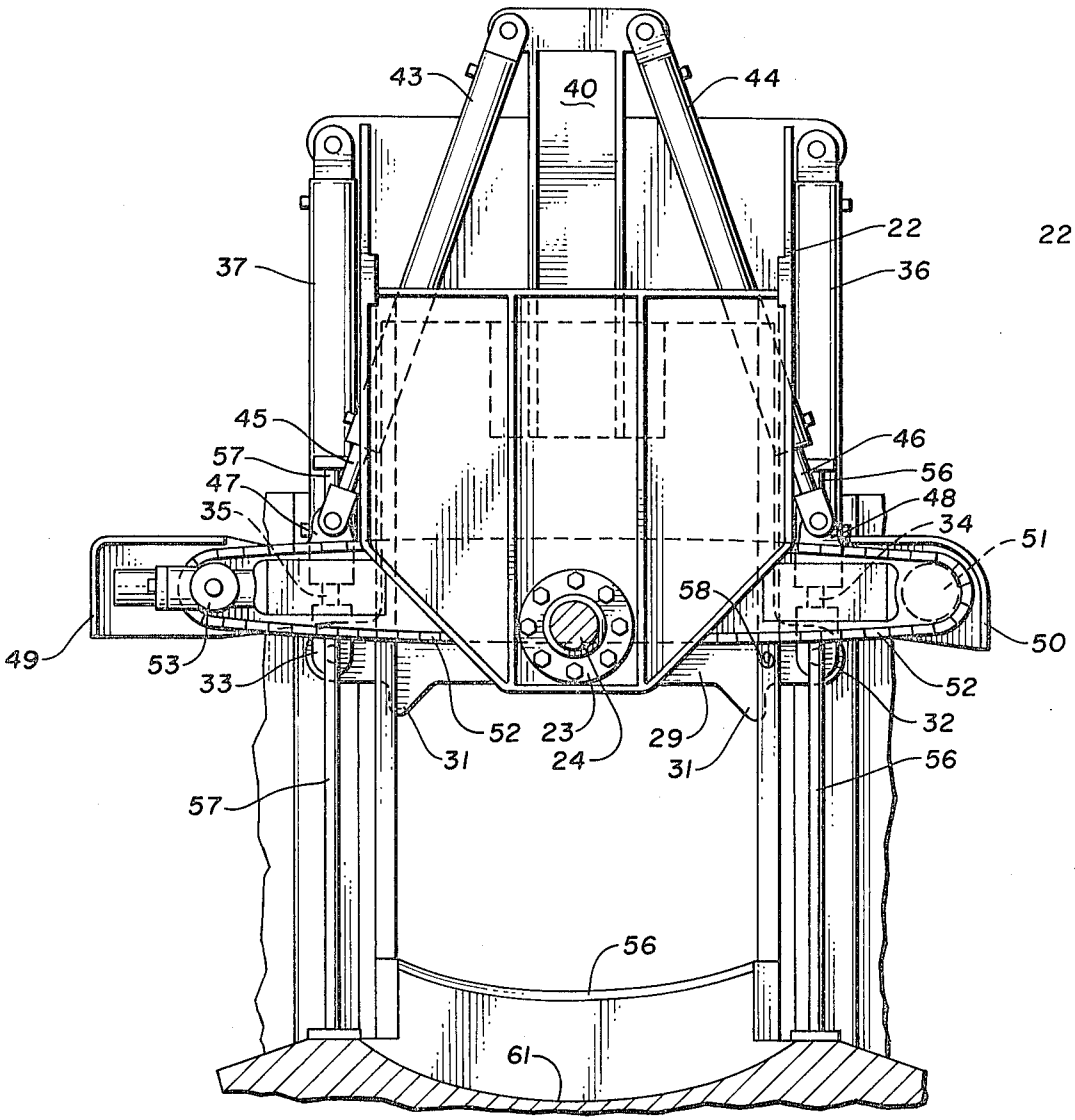
Figure 5:
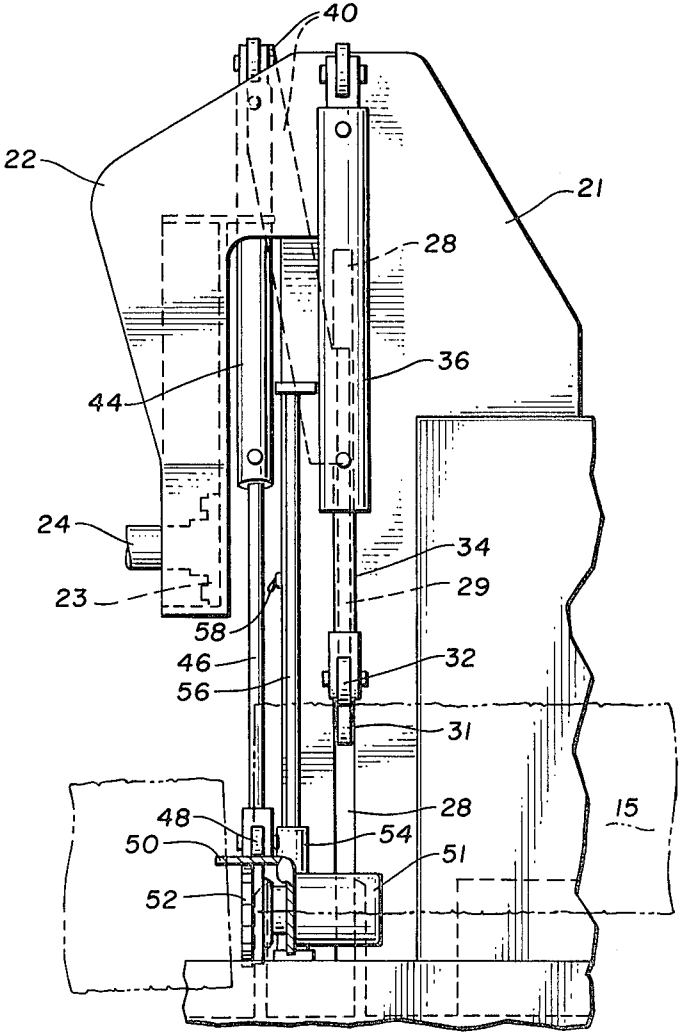
FIG. 5 is a side elevational view of the structure shown in FIG. 3, but with the clamping means in clamping position and the saw in log-severing position.
Figure 4:
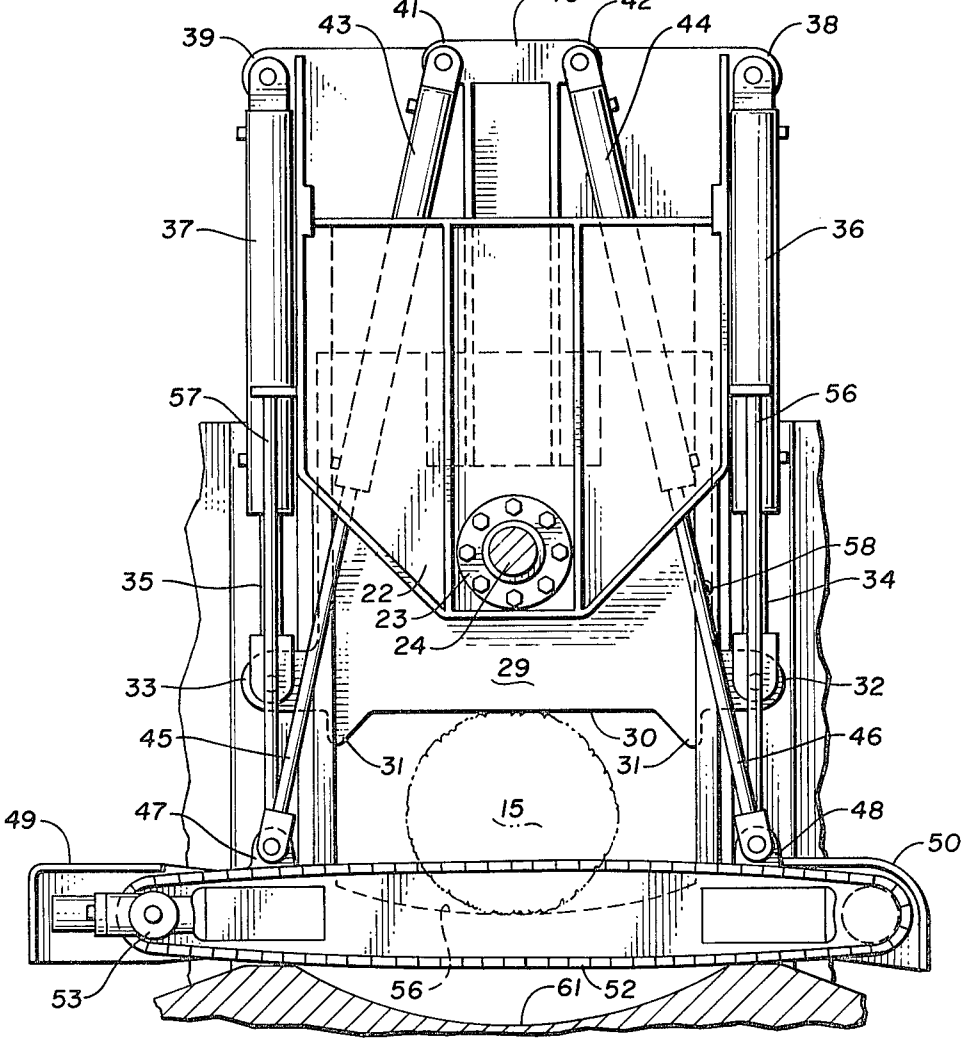
Figure 1:
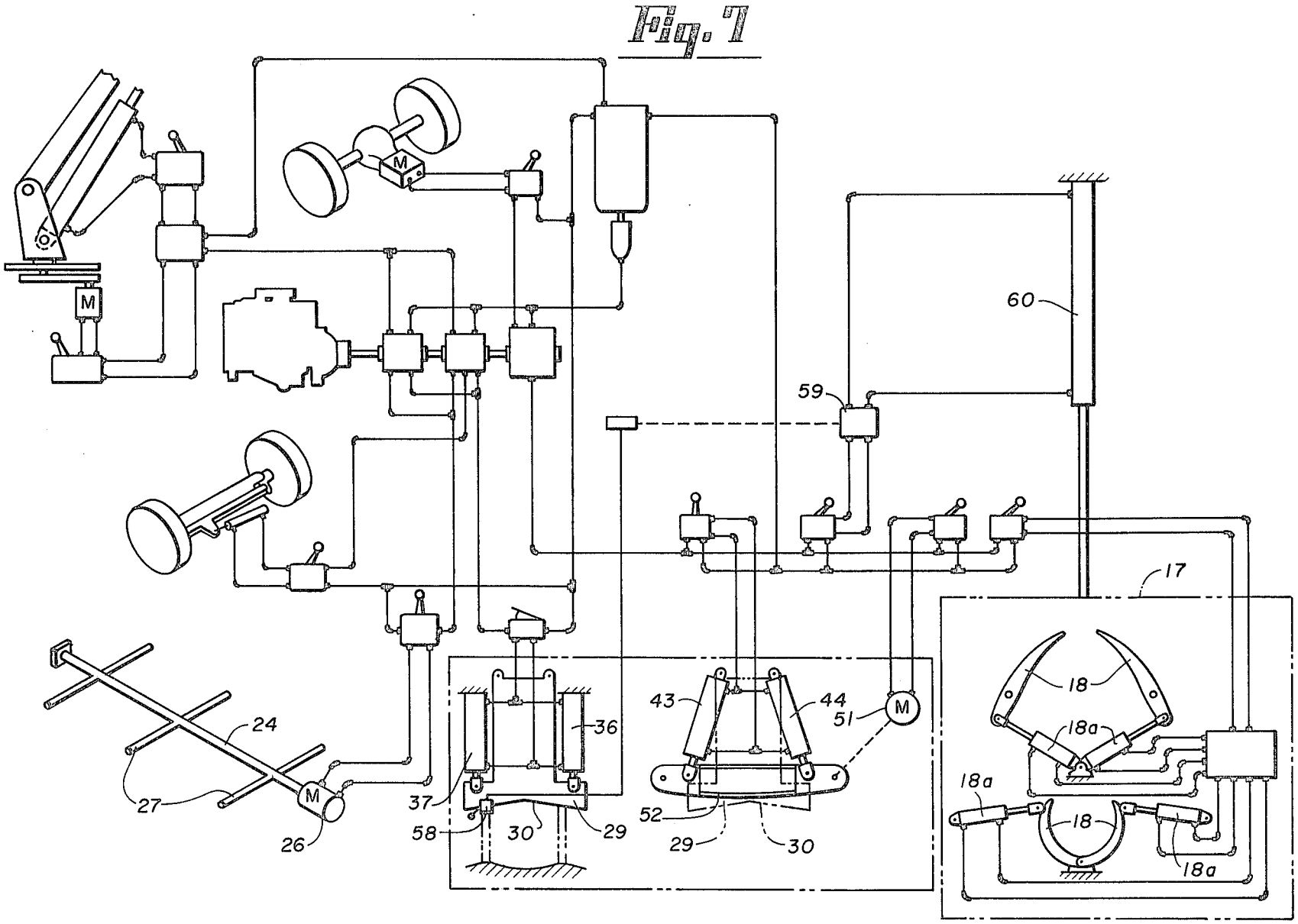

Extending vertically in each of the legs of the upstanding framework 21 at each of its sides is a guide slot 28 within which a generally rectangularly-shaped holding plate or clamp 29 is mounted for guided vertical movement between raised non-clamping (FIGS. 2 and 3) and lowered log-clamping positions (FIGS. 4 and 5). The plate 29 has a lower clamping surface 30 which is provided with a pair of spaced teeth or serrations 31.

At opposite lower corners of the clamping or hold plate 29 is a pair of ears 32, 33 which are each pivotally connected to one of a pair of piston rods 34, 35 of a pair of vertical hydraulic cylinders 36, 37. Each of these cylinders is pivotally mounted at its upper end upon outwardly extending perforated ears 38, 39 of the framework 21. These cylinders are activated and controlled through hydraulic lines which are not shown in order to avoid complicating the drawings and which are connected to control valves within the operator's cab.

Mounted upon the upper portion of the holding plate or clamp 29 and extending upwardly therefrom is a saw cylinder mounting plate 40 which has outwardly extending perforated ears 41, 42 at its upper end that pivotally support downwardly and outwardly extending saw cylinders 43, 44. The pistons 45, 46 of these cylinders are pivotally connected at their outer ends to upstanding perforated ears 47, 48 which are carried by rigid saw housings 49, 50. A hydraulic motor 51 is carried by the saw housing 50 and its drive shaft extends therethrough to drive chain saw 52 at one of its ends, as best shown in FIGS. 2 and 4. The chain saw 52 extends across the opening between the legs of framework 21 and around a freely rotating gear 53 that is carried by the opposite saw housing 49.

Mounted on the side of each of the housings 49 and 50 opposite the saw 52 is a pair of vertically extending guide sleeves 54, 55 which encircle vertical guide rods 56, 57 one each of which is fixedly mounted upon the outer side of each of the legs of the framework by mounting brackets, as shown. The guide rods 56, 57 and guide sleeves 54, 55 cooperatively guide the saw 52 and its housings 49, 50 in a vertical path relative to the holding plate or clamp 29 when the cylinders 43, 44 are actuated. Since these cylinders 43, 44 are mounted upon the clamp via plate 40, the saw 52 also moves with that holding plate or clamp.

Extending across the lower ends of the legs of the framework 21 is a holding jaw 56 which cooperates with holding plate 29 to engage and hold a tree trunk and, of course, defines a throat therewith, as best seen in FIG. 4.

A toggle switch 58 is mounted on the guiding structure for the holding plate 29 in the path of the saw housing 50 and is interposed within an electrical circuit that includes a solenoid-operated neutralizer valve 59 interposed within the hydraulic lines which feed the carriage power operator 60, as best shown in FIG. 7. The switch 58 is so constructed and arranged that the saw engages same and opens valve 59 as it reaches retracted position and closes valve 59 as it descends to log-severing position. In this manner, the power actuator 60 is made incapable of actuating carriage 17 toward saw 52 while it is disposed beneath clamping edge 30 of holding plate 29 and it becomes impossible for an operator to damage the saw by moving the carriage rearwardly while the saw is lowered.

When saw 52 is in retracted position it is disposed about three (3) inches above clamping surface 30 and it maintains that relation as holding plate 29 is lowered into log-securing position as a result of the operator extending cylinders 36 and 37. Thus, the saw is always in close proximity as soon as the log is clamped in sawing position, with a consequent substantial savings in time. We have found that, as a result, we can harvest ten (10) cords of pulpwood per hour, or if the logs are of a size such that lumber can be sawed therefrom, we can harvest 8,000–10,000 board feet of lumber (in log form) per hour.

Extending rearwardly from the log clamping and severing mechanism 19 is an elongated concavely-shaped kickout table 61 which receives the severed logs as they leave that mechanism. If the log is of sufficient size so that lumber may be sawed therefrom, the operator operates motor 26 so as to cause arms 27 to rotate and kick the log to one side into cradles 62. If it is of only pulpwood size, he operates the motor 26 in the opposite direction to kick the log out to the opposite side into similar cradles 63. When a sufficient load has accumulated in such cradles, the boom operator may utilize the grapple 13 to pick up the selected logs and deposit them in an appropriate pile. A stop 64 ensures that the logs have the desired length, the carriage 17 being operated to move the stripped log rearwardly until it engages such a stop.

The tree harvester shown herein operates quite similarly to my harvester shown in my above patent. The stripping knives are activated to grip the tree while the carriage moves rearwardly until clamping plate 29 can engage and secure same. The stripping knives are then moved to loosely engaging position and the carriage is moved forwardly, causing said knives to strip the limbs from the trunk as they move with the carriage to the front end portion of the bed. The hold plate 29 is then elevated and the entire tree is moved rearwardly by the carriage and knives until the butt of the trunk engages stop 64, the knives being in snug relation to the trunk. The hold plate is then lowered until the log or trunk is firmly secured. Saw 52 is then lowered by activating cylinders 43 and 44. When the cut is completed, the cylinders 43 and 44 are retracted, bringing the saw to retracted position above clamping surface 30, and holding plate 30 is raised. The entire operation is then repeated.

The schematic hydraulic circuit shown in FIG, 7 is similar to that shown in FIG. 11 of my above patent except that it is modified to show a pair of cylinders actuating the log holding clamp, switch 58 and neutralizer valve 59 have been shown, and saw motor 51 and its hydraulic lines have been schematically shown.

From the above, it can be seen that my improved tree harvester has a number of distinct advantages. Chief among these is the fact that is is possible to harvest trees substantially faster in that the saw is always carried in close proximity to the clamping edge, except when sawing, so that the sawing operation may begin almost at once after the tree is clamped in position, instead of having to move the same through a wide arc or path as has heretofore been the case since the saw must be retracted a substantial distance in order to be protected while the tree is being positioned. In addition, the saw herein is protected against carelessness or inadvertence on the part of the operator since it is behind the holding plate when not cutting and the carriage is inactivated against rearward movement while it is cutting.

In addition, it is possible for the operator to select and sort the logs into pulpwood and lumber types by utilizing my selective kick-out mechanism, thereby saving a great deal of time and expense.

In considering this invention, it should be remembered that the present disclosure is illustrative only and the scope of the invention should be determined by the appended claims.

What is claimed is:

1. A tree harvesting machine comprising:

(a) a supporting frame;

(b) an elongated bed carried by said frame and constructed and arranged to support thereon a tree to be harvested;

(c) a carriage movably carried by said frame for reciprocating movement longitudinally of said bed;

(d) powered means connected to said carriage for reciprocating the same longitudinally of said bed;

(e) limb-stripping means carried by said carriage and movable therewith and constructed and arranged to extend around the trunk of such a tree alternatively in either snug or loosely-engaging relation, as desired, when the tree is supported by said bed;

(f) actuator means connected to said limb-stripping means in actuating relation to cause the same to selectively engage the trunk of such a tree in either snug or loosely-engaging relation as desired, whereby said limb-stripping means will move such a tree longitudinally of said bed when in snug engaging relation thereto as said carriage moves rearwardly along said bed and will stip the limbs off the trunk of such a tree when in loosely-engaging relation thereto as said carriage moves forwardly relative to the trunk of the tree;

(g) powered clamping means movably supported by said frame above said bed at a fixed location relative thereto and intermediate the extent of said frame and in position to receive and clamp the trunk of such a tree upon said bed;

(h) powered saw means carried by said clamping means and movable therewith between the clamping and non-clamping positions thereof;

(i) said saw means being movably mounted on said clamping means for movement relative thereto between a retracted position and a tree-trunk sawing position; and (j) powered control means connected to said saw for controllably moving the same between its said positions.

2. The structure defined in claim 1 wherein said clamping means has a clamping surface extending transversely of said bed and said saw means extends generally parallel to said clamping surface.

3. The structure defined in claim 1, (k) an upright framework carried by said frame intermediate its extent and supporting said clamping means and saw means, (l) said clamping means including:

(1) a generally rectangular vertical holding plate having a serrated lower holding edge for engaging and holding the trunk of such a tree, and (2) a pair of vertical hydraulic cylinders, one each of which is pivotally connected at its lower end to opposite lower corner portions of said plate and is pivotally connected at its upper end to the upper portions of said framework for moving said holding plate between tree clamping and non-clamping positions.

4. The structure defined in claim 1, (k) an upright framework carried by said frame intermediate its extent and supporting said saw means and said clamping means;

(l) said clamping means including a generally vertically extending holding plate for engaging and holding the trunk of such a tree;

(m) said saw means including:

(1) a generally horizontally extending powered chain saw, (2) a saw mounting plate carried by said holding plate in elevated relation thereto, and (3) a pair of hydraulic cylinders each pivotally connected to opposite end portions of said saw and extending upwardly and inwardly therefrom toward each other to said mounting plate and being pivotally connected thereto.

5. The structure defined in claim 1, (k) an upright framework carried by said frame intermediate its extent and supporting said saw means and said clamping means;

(l) powered means extending between said framework and said saw means for moving the latter toward and away from said bed;

(m) said saw means including:

1. a generally horizontally extending powered chain saw, 2. a pair of vertically extending guide rods, one each of which is mounted at opposite sides of said upright framework, and 3. a pair of guide sleeves mounted upon opposite end portions of said saw, one each of which is arranged in pierced relation with one of said guide rods whereby said saw means is guided as it is so moved.

6. The strucrture defined in claim 1 in which said clamping means has a clamping surface facing said bed and said retracted position of said saw means is located on a side of said clamping surface opposite said limb-stripping means.

7. The structure defined in claim 1, wherein said powered means reciprocating said carriage is controlled by an electrically controlled hydraulic valve which, when closed, precludes reciprocation of said carriage and, when open, makes reciprocation of said carriage possible, and (k) switch means connected in valve controlling relation with said valve and carried by said frame in position relative to said saw means to be engaged and moved by said saw means to valve-closing position as the latter moves to a tree-trunk sawing position, and to be moved by said saw means to valve-opening position as said saw means returns to retracted position.

8. The structure defined in claim 1, wherein said clamping means has a clamping surface extending transversely of said bed and said saw means includes a generally horizontally extending chain saw traversing at least the major portion of the length of said clamping surface of said clamping means.

9. The structure defined in claim 1, wherein said clamping means includes guide structure therefor to guide the same as it moves between tree clamping and non-clamping positions relative to said bed, and (k) switch means mounted on said guide structure in position relative to said saw means to be moved between open and closed positions by said saw means as the latter moves between retracted and tree-sawing positions, said switch means being connected in controlling relation with said powered means connected to said carriage to preclude reciprocation of said carriage while said saw means is in tree-trunk sawing position.

10. The structure defined in claim 1, and (k) selective ejector means carried by said frame on the side of said saw means opposite said carriage means.

11. The structure defined in claim 1, and selective log-ejecting means carried by said frame on the side of said saw means opposite said clamping means.

12. The structure defined in claim 1, and powered rotary log-ejecting means carried by said frame rearwardly of and adjacent to said saw means and extending longitudinally of said bed and rotating about an axis extending longitudinally of said bed, said ejecting means being selectively rotatable in opposite directions to selectively engage and discharge severed sections of such a tree to opposite sides of said bed after they have been cut by said saw means.

13. The structure defined in claim 1 wherein said saw means includes a generally horizontally extending chain saw; and (k) a hydraulic motor mounted upon one and portion of said saw in driving relation with said saw and moving therewith.

14. The structure defined in claim 1, wherein said supporting frame is mobile.

15. A tree harvesting machine comprising:

(a) a support frame;

(b) an elongated bed carried by said frame and constructed and arranged to support thereon a tree to be harvested;

(c) a carriage movably carried by said frame for reciprocating movement longitudinally of said bed;

(d) powered means connected to said carriage for reciprocating the same longitudinally of said bed;

(e) limb-stripping means carried by said carriage and movable therewith and constructed and arranged to extend around the trunk of such a tree alternatively in either snug or loosely-engaging relation, as desired, when the tree is supported by said bed;

(f) actuator means connected to said limb-stripping means in actuating relation to cause the same to selectively engage the trunk of such a tree in either snug or loosely-engaging relation as desired. whereby said limb-stripping means will move such a tree longitudinally of said bed when in snug engaging relation thereto as said carriage moves rearwardly along said bed, and will strip the limbs off the trunk of such a tree when in loosely-engaging relation thereto as said carriage moves forwardly relative to the trunk of the tree;

(g) powered clamping means movably supported by said frame for vertical movement only above said bed at a fixed location relative thereto, and intermediate the extent of said frame and in position to receive and clamp the trunk of such a tree upon said bed;

(h) powered saw means carried by said clamping means adjacent to and rearwardly of said clamping means and movable therewith between the clamping and non-clamping positions thereof and constructed and arranged to saw off a section of the trunk of such a tree while the latter is clamped by said clamping means;

(i) said saw means being constructed and arranged for movement between a retracted and a tree-trunk sawing position;

(j) powered control means connected to said saw for controllably moving the same between its said positions; and (k) controllably selective rotary ejector means carried by said frame and constructed and arranged relative to said bed, clamping means, and saw means to be selectively rotated and engage such a cut section of a tree trunk to thereby selectively eject the same to either side of said bed as desired.

16. The structure defined in claim 15, (l) said rotary ejector means including an elongated shaft extending longitudinally of said bed and rotatably mounted on said frame for rotation about its longitudinal axis;

(m) said shaft having a plurality of ejecting arms extending radially therefrom in position to engage such sections of a tree trunk as they are cut in opposite directions; and (n) controllable bi-directional rotary power means connected to said shaft for selectively rotating the same about its longitudinal axis in either direction, whereby the cut sections of the trunk may be ejected to either side of the bed as desired.

* * * * *

UNITED STATES PATENT AND TRADEMARK OFFICE

CERTIFICATE OF CORRECTION

PATENT NO. : 4,382,457

DATED : May 10, 1983

INVENTOR(S) : Raymond M. Hahn

It is certified that error appears in the above-identified patent and that said Letters Patent are hereby corrected as shown below:

Column 2, line 28 "The" should be --An--.

Column 7, line 39, after one "and" should be --end--.

Signed and Sealed this

*Second* Day of *August 1983*

[SEAL]

*Attest:*

GERALD J. MOSSINGHOFF

*Attesting Officer*

*Commissioner of Patents and Trademarks*